US009421405B1

(12) United States Patent
Murray et al.

(10) Patent No.: US 9,421,405 B1
(45) Date of Patent: Aug. 23, 2016

(54) STOVETOP FIRE EXTINGUISHER INITIATOR WITH FUSE DEVICE AND METHOD

(71) Applicants: Donald W Murray, Arlington, TX (US); Richard M Anthony, River Oaks, TX (US)

(72) Inventors: Donald W Murray, Arlington, TX (US); Richard M Anthony, River Oaks, TX (US)

(73) Assignee: WilliamsRDM, Inc., Fort Worth, TX (US)

( * ) Notice: Subject to any disclaimer, the term of this patent is extended or adjusted under 35 U.S.C. 154(b) by 521 days.

(21) Appl. No.: 13/904,204

(22) Filed: May 29, 2013

Related U.S. Application Data

(60) Provisional application No. 61/803,045, filed on Mar. 18, 2013.

(51) Int. Cl.
*H01H 69/02* (2006.01)
*A62C 37/12* (2006.01)
*A62C 3/00* (2006.01)

(52) U.S. Cl.
CPC ..... *A62C 37/12* (2013.01); *A62C 3/006* (2013.01); *H01H 69/02* (2013.01)

(58) Field of Classification Search
CPC ..... A62C 3/006; H01H 69/02
USPC ..... 29/623; 86/22; 169/65
See application file for complete search history.

(56) References Cited

U.S. PATENT DOCUMENTS 1,366,873 A 1/1921 Carpenter
1,766,912 A 6/1930 Laengel
1,816,892 A 8/1931 Bronander
2,687,553 A * 8/1954 Colombo ..... C06C 5/08 102/275.1
3,040,815 A 6/1962 Pambello
3,209,837 A 10/1965 Freedman
3,552,259 A * 1/1971 Griffith ..... C06C 5/08 264/3.1
3,757,866 A 9/1973 Mears et al.
3,773,111 A 11/1973 Dunn
3,782,475 A 1/1974 Schmidt
3,833,063 A 9/1974 Williams
3,874,459 A 4/1975 Williams
3,884,306 A 5/1975 Williams
3,884,307 A 5/1975 Williams
3,885,303 A * 5/1975 Deelman ..... H01H 69/02 29/417

(Continued)

OTHER PUBLICATIONS

International Search Report and Written Opinion and Examiner Search Strategy, mail date Jun. 26, 2915, PCT/US2015/014339, 16 pages.

(Continued)

*Primary Examiner* — Reginald Tillman, Jr.
(74) *Attorney, Agent, or Firm* — Morani Patent Law, PC

(57) ABSTRACT

An initiator with fuse device for an automatic self-contained fire suppressor and method are provided herein. Stovetop fires are a well-known residential and commercial hazard. The initiator with fuse device for an automatic stovetop fire suppressor has a rapid light time in the presence of flames. The time to light is consistent and reliable for the fuse described herein. Comparative tests show a shorter light time for the present fuse as compared to conventional fuses. Further, the variability in lighting times is shortened when the herein described configuration is employed. Deployment of an automatic stovetop fire suppressor can be safer than manual extinguishing means and via the initiator with fuse described herein, the time to deployment is greatly improved. Manufacturing of the initiator with fuse is readily adapted to existing processes.

4 Claims, 6 Drawing Sheets

(56) References Cited

U.S. PATENT DOCUMENTS

| | | | | | |
|---|---|---|---|---|---|
| 3,897,826 | A | | 8/1975 | Glover | |
| 3,918,526 | A | | 11/1975 | Hattori | |
| 3,995,525 | A | * | 12/1976 | Blair | C06C 5/04 102/275.8 |
| 4,011,911 | A | | 3/1977 | Gow | |
| 4,065,849 | A | * | 1/1978 | Kozacka | H01H 69/02 228/180.1 |
| 4,113,020 | A | | 9/1978 | Panetta | |
| 4,205,431 | A | * | 6/1980 | Wiebe | H01H 69/02 228/180.1 |
| 4,409,729 | A | * | 10/1983 | Shah | H01H 69/02 29/623 |
| 4,607,573 | A | * | 8/1986 | Thureson | C06C 5/04 102/275.5 |
| 4,964,469 | A | | 10/1990 | Smith | |
| 5,317,974 | A | * | 6/1994 | Stewart | B29C 47/0004 102/275.8 |
| 5,351,760 | A | | 10/1994 | Tabor | |
| 5,518,075 | A | | 5/1996 | Williams | |
| 5,628,367 | A | | 5/1997 | Truax et al. | |
| 5,844,322 | A | * | 12/1998 | Andersson | B29C 47/0023 102/332 |
| 5,868,205 | A | | 2/1999 | Cunningham et al. | |
| 5,871,057 | A | | 2/1999 | Stehling et al. | |
| 5,881,819 | A | | 3/1999 | Walters et al. | |
| 5,899,278 | A | | 5/1999 | Mikulec | |
| 6,029,751 | A | | 2/2000 | Ford et al. | |
| 6,105,677 | A | | 8/2000 | Stager | |
| 6,244,353 | B1 | | 6/2001 | Greer | |
| 6,276,461 | B1 | | 8/2001 | Stager | |
| 6,796,382 | B2 | | 9/2004 | Kaimart | |
| 7,182,143 | B2 | | 2/2007 | Hall et al. | |
| 7,472,758 | B1 | | 1/2009 | Stevens | |
| 7,610,966 | B1 | | 11/2009 | Weintraub et al. | |
| 7,934,564 | B1 | | 5/2011 | Stell et al. | |
| 7,969,296 | B1 | | 6/2011 | Stell | |
| 8,294,567 | B1 | | 10/2012 | Stell | |
| 2003/0010506 | A1 | | 1/2003 | Braun | |
| 2006/0230606 | A1 | * | 10/2006 | Dowil | H01C 3/06 29/623 |
| 2008/0087446 | A1 | | 4/2008 | Sitabkhan | |

OTHER PUBLICATIONS

International Search Report and Written Opinion and Examiner Search Strategy, mail date Jun. 11, 2015, PCT/US2015/014148, 16 pages.

* cited by examiner

STOVETOP FIRE EXTINGUISHER INITIATOR WITH FUSE DEVICE AND METHOD

CROSS REFERENCE TO RELATED APPLICATIONS

This application claims priority to U.S. Provisional Application No. 61/803,045, filed 18 Mar. 2013, the entire contents of which are incorporated herein by reference.

FIELD OF THE INVENTION

The present invention relates to a device and method of fire suppression, and more particularly to initiating an automatic stovetop fire suppressor.

BACKGROUND OF THE INVENTION

Stovetop fires are a well-known residential and commercial hazard. An unattended stovetop fire, for example a grease fire, can cause damage to nearby appliances and cabinets. Worse, stovetop fires can lead to structural damage or injury. Because the propensity for stovetop fires is so pervasive, an efficient means of automatic fire suppression is desired. Even if a stovetop fire is attended, an automatic extinguishing method may be more effective, safe, and expedient compared to manual means.

A number of conventional automatic stovetop fire extinguishers, which mount above the stovetop surface, are available. These include: U.S. Pat. No. 6,276,461 to Stager: U.S. Pat. No. 6,105,677 to Stager; U.S. Pat. No. 5,899,278 to Mikulec; U.S. Pat. No. 7,472,758 to Stevens and Weintraub; U.S. Pat. No. 7,610,966 to Weintraub et al; U.S. Pat. No. 5,518,075 to Williams; and U.S. Pat. No. 3,884,307 to Williams. The array of conventional fire suppression systems vary from activation by melting of a fusible pin (Stager '461), to melting a solder fusible plug (Stager '677), to burning of a fuse (Williams '307, Stevens '758), or to activating via a glass bulb fuse mechanism (Mikulec). The mounting mechanism for these systems similarly vary from interconnected tubing (Mikulec) to pendulum anchors (Stager '461), to bolts (Stager '677), or to magnetic systems requiring assembly (Williams '307 and Williams '075).

Conventional fire suppresors, STOVETOP FIRESTOP® fire suppressor (Williams-Pyro, Inc., Fort Worth, Tex., USA), which are particularly well suited to a stovetop environment, include a container of an extinguishing agent mounted to a vent hood above the stovetop and activated by a fuse. An example of such an suppressor is shown in FIG. 1. The bottom of the container contains a fuse. A fire on the stovetop ignites the fuse, which in turn detonates an igniter. The igniter opens the bottom of the container, thereby allowing the disbursement of the extinguishing agent onto the fire and the stovetop. In the example shown in FIG. 1, the container is secured via a magnet to a hood over the stove.

A conventional initiator comprising a fuse is shown in greater detail in FIG. 2. The conventional initiator is further described below with reference to FIG. 2. The conventional fuse assembly is effective at heat activating the initiator cup; however, a shortened activation time with excellent reproducibility of the same for a stovetop fire suppressor would be desirable for reasons to include safety and damage to surrounding structures and figures.

SUMMARY OF THE INVENTION

The present invention addresses some of the issues presented above by providing a new fuse for heat activation of the initiator in an automatic stovetop fire extinguisher Embodiments of the present invention may have any of the aspects below.

One aspect of the present invention is to provide an efficient heat activation apparatus for a stovetop fire suppressor.

Another aspect of the present invention is to provide an improved consistency in heat activation time for an automated stovetop fire suppressor.

Another aspect of the present invention is to provide a minimal time of heat activation time for an automated stovetop fire.

Another aspect of the present invention is to provide a fast lighting fuse in the presence of flames in a stovetop fire suppressor.

Another aspect of the present invention is to provide a minimal time of heat activation time for an automated stovetop fire suppressor with minimal additional manufacturing steps.

Yet another aspect of the present invention is to provide very low variability in heat activation time for an automated stovetop fire suppressor while shortening the time to fuse ignition for a given flame exposure.

Still another aspect of the present invention is to provide a method of making a fuse that yields a consistent fuse lighting time.

Those skilled in the art will further appreciate the above-noted features and advantages of the invention together with other important aspects thereof upon reading the detailed description that follows in conjunction with the drawings.

BRIEF DESCRIPTION OF THE FIGURES

For more complete understanding of the features and advantages of the present invention, reference is now made to the detailed description of the invention along with the accompanying figures, wherein.

DETAILED DESCRIPTION OF THE INVENTION

The invention, as defined by the claims, may be better understood by reference to the following detailed description. The description is meant to be read with reference to the figures contained herein. This detailed description relates to examples of the claimed subject matter for illustrative purposes, and is in no way meant to limit the scope of the invention. The specific aspects and embodiments discussed herein are illustrative of ways to make and use the invention, and are not intended to limit the scope of the invention. Same reference numbers across figures refer to like elements for ease of reference. Reference numbers may also be unique to a respective figure or embodiment.

Figure 1:
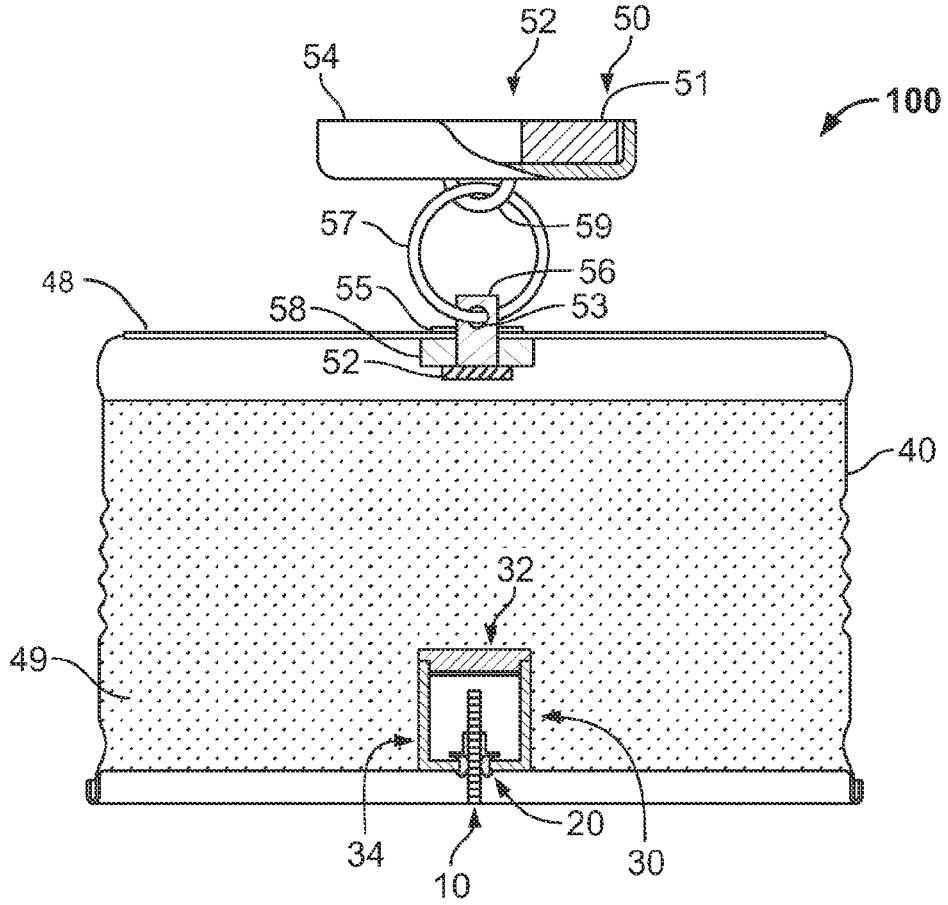
FIG. 1 Prior Art
FIG. 1 shows a cross sectional view of a conventional stovetop fire suppressor for mounting under a vent-hood above a stove top surface along its axial center with a partial cross section of the mounting magnet.

FIG. 1 shows a cross section of a conventional stovetop fire suppressor for mounting under a vent-hood 100 above a stove top surface along the axial center of the device. Within magnet housing 54 the partial cross section shows magnet 51. Magnet 51 is ring shaped and has a center hole 52. The surface 50 attaches to, for example, a vent hood to correctly position the stovetop fire suppressor for activation when needed. Mounting ring 57 threads through magnet housing loop 59 at one end and through the clevis pin 56 eye 53 on another end. Clevis pin 56 passes through an opening in the top 48 of the fire suppressor container 40. The fire suppressor container 40 is filled with a fire suppressant powder 49, which is conventionally a powder. Clevis pin 56 has a shoulder 52 and a felt washer 58 is sandwiched between shoulder 52 and an inside of the top 48 of the container 40. A retaining ring 55 secures the clevis pin 56 in the position shown in FIG. 1. A conventional initiator 30 comprises an initiator cap 32 and an initiator cup 34. The initiator 30 is secured to the container 40 lower lid 20. Extending from outside the lid 20 of the container 40 and into the initiator 30 is fuse 10. Conventionally, the fuse 10 has a straight end cut, as shown.

Figure 2:
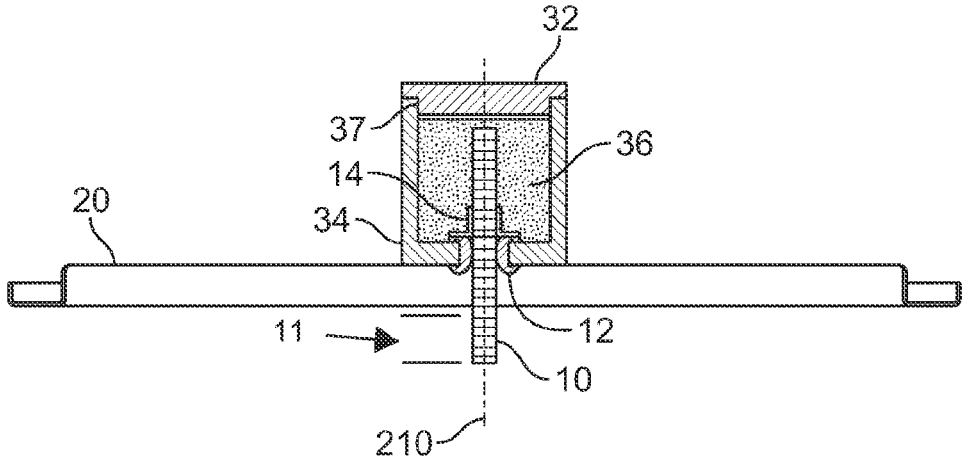
FIG. 2 shows a cross section of a conventional initiator and heat activated fuse in greater detail.

FIG. 2 shows a cross section of a conventional initiator 30 with fuse mounted to a lid 20 in greater detail. Conventional methods of forming an suppressor initiator include attaching the cup to the lid. Referring to FIG. 2, the initiator forming is further described. For example, the cup 34 is placed over a lower die in a press/staking machine, the suppressor container lid 20 is placed on top of the cup and then first eyelet 12 is placed in the upper die. The press is activated and the eyelet 12 is driven down through the suppressor lid and initiator cup and formed 12 on the inside of the cup 34 to firmly attach the bottom of the initiator cup 34 and the suppressor container lid 20 together. This first eyelet 12 has a center hole that provides the inlet of the fuse 10 into the initiator cup 34.

A fuse assembly may be created by placing a second eyelet 14 on a pre-cut length of fuse 10. The fuse is cut perpendicular to the axial orientation 210 of the fuse, and the resulting straight edge fuse 10 is shown in FIG. 2. The eyelet 14 is then positioned in place and crimped to attach it to the fuse 10. The fuse assembly is then inserted through the hole in the first eyelet 12 from the inside of the initiator cup 32. A gun powder substitute 36 is then dispensed into the cup/lid/fuse assembly. And finally, a cap 32 is placed on the open end 37 of the cup and the two parts are ultrasonically welded together to form an initiator for a stovetop fire suppressor 30.

Figure 3:
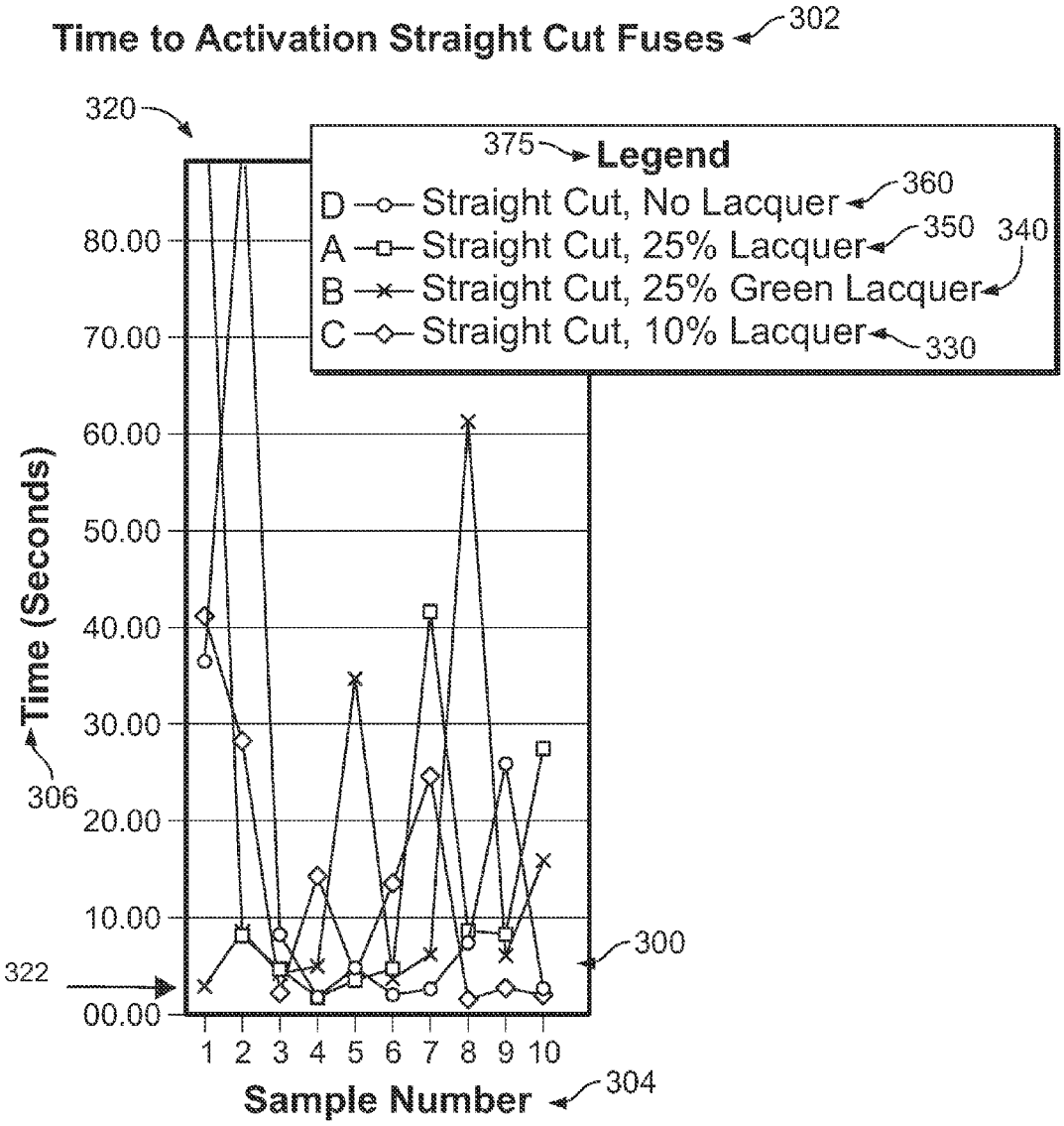
FIG. 3 shows a graphical representation of experimental data testing the activation times of conventional fuses in an automatic stovetop fire suppressor.

We investigated both the lighting times for a conventional fuse type and configuration and the consistency of lighting times for the same conventional fuse types. First, the responsiveness of the conventional fuse configuration with a conventional lacquer was determined experimentally. The test setup included a Bunsen burner and a fuse retaining fixture which left an exposed fuse portion 11 similar to that shown in FIG. 2. Each fuse sample was loaded into the fixture and positioned 4.75" directly above the Bunsen burner flame. The gas supply to the Bunsen burner was held constant. The time to light the fuse was recorded for 10 samples and the condition of lit was determined by visual inspection. FIG. 3 shows a graphical representation of data acquired by the above described experimental setup and procedures. Samples of the conventional configuration and conventional lacquer (clear 25% nitrocellulose) are represented by A 350, see legend 375 shown in FIG. 3. Conventional fuse types are an American visco fuse with an approximate diameter of 3/32 inches and which are red in color and are lacquer coated off the shelf. (Fireworks International, Virginia Beach, Va., USA). After cutting the fuse to the desired length, conventionally and in accordance with embodiments of the present invention, a coat of lacquer is applied to the external cut end of the fuse to seal it. The conventional lacquer end coat is a clear twenty-five percent nitrocellulose lacquer, for example, an OPEX nitrocellulose alkyd production lacquer (Sherwin Williams, Cleveland, Ohio, USA).

Samples from one to ten were taken for the A 350, B 340, C 330 lacquered and non-lacquered D 360 straight cut conventional fuse configurations, where B 340 samples were coated with a green 25% nitrocellulose lacquer, A 350 samples were coated with a 25% concentrated mix of nitrocellulose N-butyl acetate lacquer on the cut end and C 330 samples were coated with a 10% nitrocellulose lacquer (Skylighter, Inc., Round Hill, Virginia, USA) on the cut end and D 360 samples were bare, lacking any lacquer coating coated onto the cut end. In experimental setup and in practice the lacquer may be applied to the exposed and mounted fuse with a commercially available liquid dispenser, excess lacquer can run down to the first eyelet and fuse interface. In accordance with the present invention, alternate coating methods may be employed such as painting by hand or by spraying. The application method employed was consistent across all test samples.

The time to fuse lightings 302 are provided in seconds, along the Y axis in seconds 306. The sample numbers, 1 through 10 are provided on the X axis 304 for the A 350, B 340, C 330, and D 360 fuse types, respectively, for a total of 40 fuses tested. The activation times for each sample were plotted in seconds. Each different fuse type and respective sample was identically mounted and positioned above the Bunsen burner. Conventional fuse types are a visco fuse, which is lacquer coated off the shelf. After cutting the fuse to the desired length, a coat of lacquer is applied to the external cut end of the fuse to seal it.

The straight cut fuse sample lighting times varied between two seconds 322 and more than eighty seconds 320. The variation in lighting times for a given lacquer, A 350, B 340, or C 330 varied by at least twenty fold. Even the non-lacquered end cut fuse, D 360, samples varied more than twenty fold for lighting times across ten samples and reached a lighting time in excess of forty seconds.

A conventional visco fuse typically consists of a burning core coated with wax or lacquer for durability and water resistance. A visco fuse typically has a core of black powder with one or more outer wraps of textile about the vertical axis. Further, the outer layers may be coated with wax or nitrocellulose lacquer for water and dirt resistance, and the outer coating may also provide mechanical protection. These fuses burn at a uniform rate, with an easily visible external flame. Depending on the outer coating, visco fuses may be water resistant.

Figure 4:
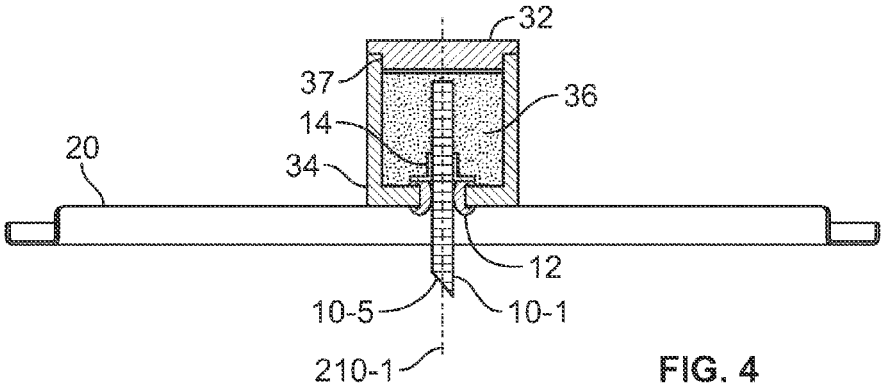
FIG. 4 shows a cross section of an initiator and heat activated angle cut fuse in greater detail, in accordance with an exemplary embodiment of the present invention.

FIG. 4 shows a cross section of an initiator 30 and angle cut fuse 10-1 in greater detail, in accordance with an exemplary embodiment of the present invention. Fuses are cut to yield a forty five degree angle 10-5 with the fuse vertical axis 210-1. In accordance with an exemplary embodiment, the cut process for an angle cut fuse includes placing a long piece of fuse on a horizontal workbench. Holding the fuse against a straight edge, a razor was aligned with a forty five degree mark and the fuse was cut with a razor blade by pressing downward by hand. The blade was held perpendicular to the cutting plane. A protractor was used to measure and confirm a forty five degree angle with respect to the fuse axial length, vertical axis. The resulting angles of the cut fuses were measured with a protractor and all samples tested were within approximately plus or minus three degrees of a forty five degree angle cut. The initiator cup 34, cap 32, container lid 20, first eyelet 12 and second eyelet 14 are consistent with those described above with reference to FIG. 2.

Figure 5:
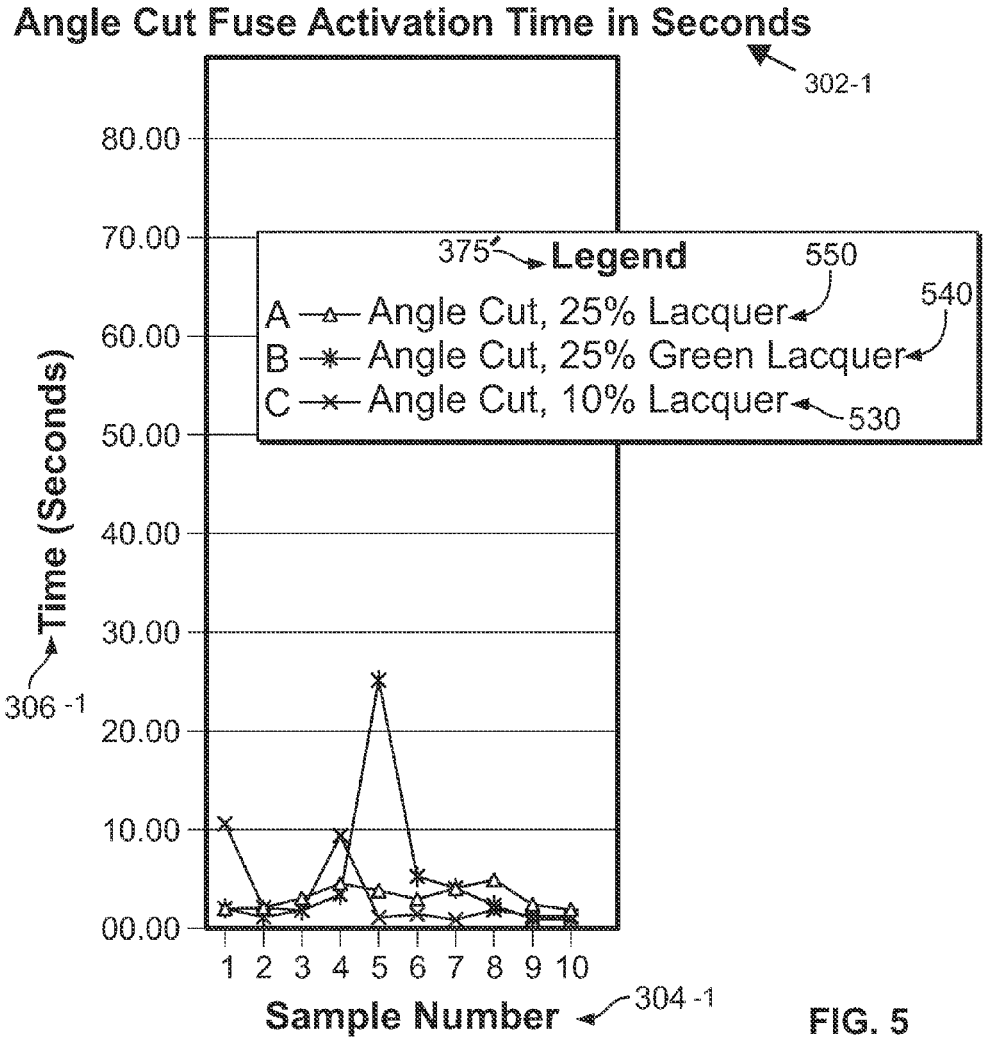
FIG. 5 shows a graphical representation of experimental data testing the activation times of angle cut fuses, in accordance with exemplary embodiments of the present invention.

FIG. 5 shows graphical representation of experimental data testing the activation times 302-1 of angle cut fuses, the angle cut 10-5 shown in FIG. 4, in accordance with exemplary embodiments of the present invention. Samples from one to ten were taken for the A' 550, B' 540, and C' 530 lacquered 45 degree angle cut fuse configurations, where A' 550 samples were coated with conventional lacquer (clear 25% nitrocellulose) on the cut end, B' 540 samples were coated with a green 25% nitrocellulose lacquer, 25% concentrated mix of nitrocellulose N-butyl acetate lacquer on the cut end and C 530 samples were coated with a 10% nitrocellulose lacquer (Skylighter, Inc., Round Hill, Virginia, USA). Symbols for the different sample types A' 550, B' 540, and C' 530 are summarized in legend 375'. The time to fuse lightings are provided in seconds, along the Y axis 306-1. The sample numbers, 1 through 10 304-1 are provided on the X axis 304-1 for the A' 550, B' 540, and C' 530, cut angle fuses, respectively, for a total of 30 fuses tested. The activation times for each sample were plotted in seconds 306-1. Each different fuse lacquer and respective sample was identically mounted and positioned above the Bunsen burner as described above.

The angle cut fuse sample lighting times showed much lower variability and lower average and maximum lighting times. Angle cut fuses varied between less than two seconds to less than 28 seconds. The average lighting times for a given lacquer, A' 550, B' 540, and C' 530 was greatly reduced as compared to the straight edge cut fuses, shown in FIG. 3. Referring again to FIG. 5, average lighting times for the angle cut fuses could be reduced to less than five seconds across 10 samples. In alternate embodiments, different lacquers can be used in accordance with the present invention; all three lacquers tested showed decreased lighting times and decreased variability with the angle-cut end as compared to a straight cut end.

Figure 6:
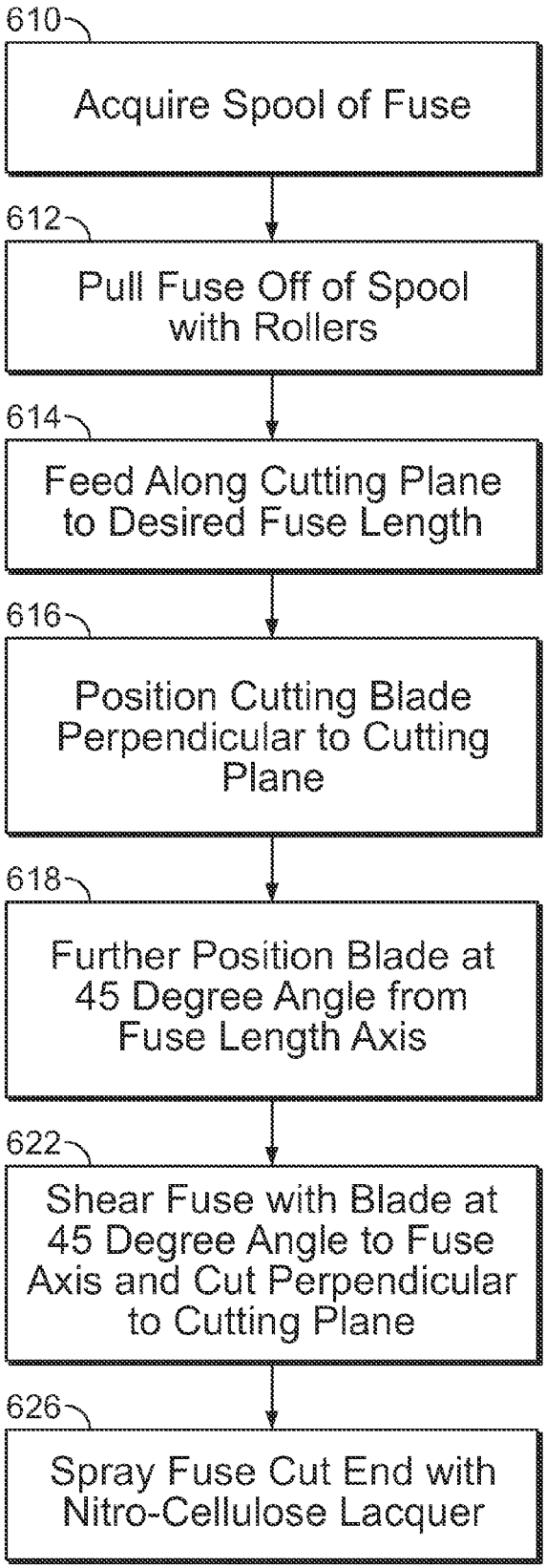
FIG. 6 shows an exemplary method of making a fuse for an automatic stovetop fire suppressor container, in accordance with an exemplary embodiment of the present invention.

FIG. 6 shows a method of making a fuse for an automatic stovetop fire suppressor container, in accordance with an exemplary embodiment of the present invention. Briefly, in production, the fuse can be pulled off of a spool by a set of rollers, fed to length horizontally along the cutting plane and sheared by a vertical cutting blade where the blade is set to a 45 degree angle relative to the axial direction. The angle cut fuse, in accordance with the present invention, changes the orientation of the cutting blade but does not add additional steps to the manufacturing method of making the fuse. A faster and more consistent fuse is obtained in the absence of increased manufacturing time and costs. Referring to FIG. 6, acquire spool of fuse 610, pull fuse off of spool with rollers 612, and feed along cutting plane to desired fuse length 614. Position cutting blade perpendicular to cutting plane 616 and further position blade at 45 degree angle from fuse length axis 618. Shear fuse from spool feed with blade at 45 degree angle to fuse axis and cut perpendicular to cutting plane 622. And once cut, spray, or otherwise coat, fuse cut end with nitrocellulose lacquer 626. In accordance with embodiments of the present invention, coating of the cut end of the fuse may be performed after the fuse is mounted in the initiator.

Figure 7:
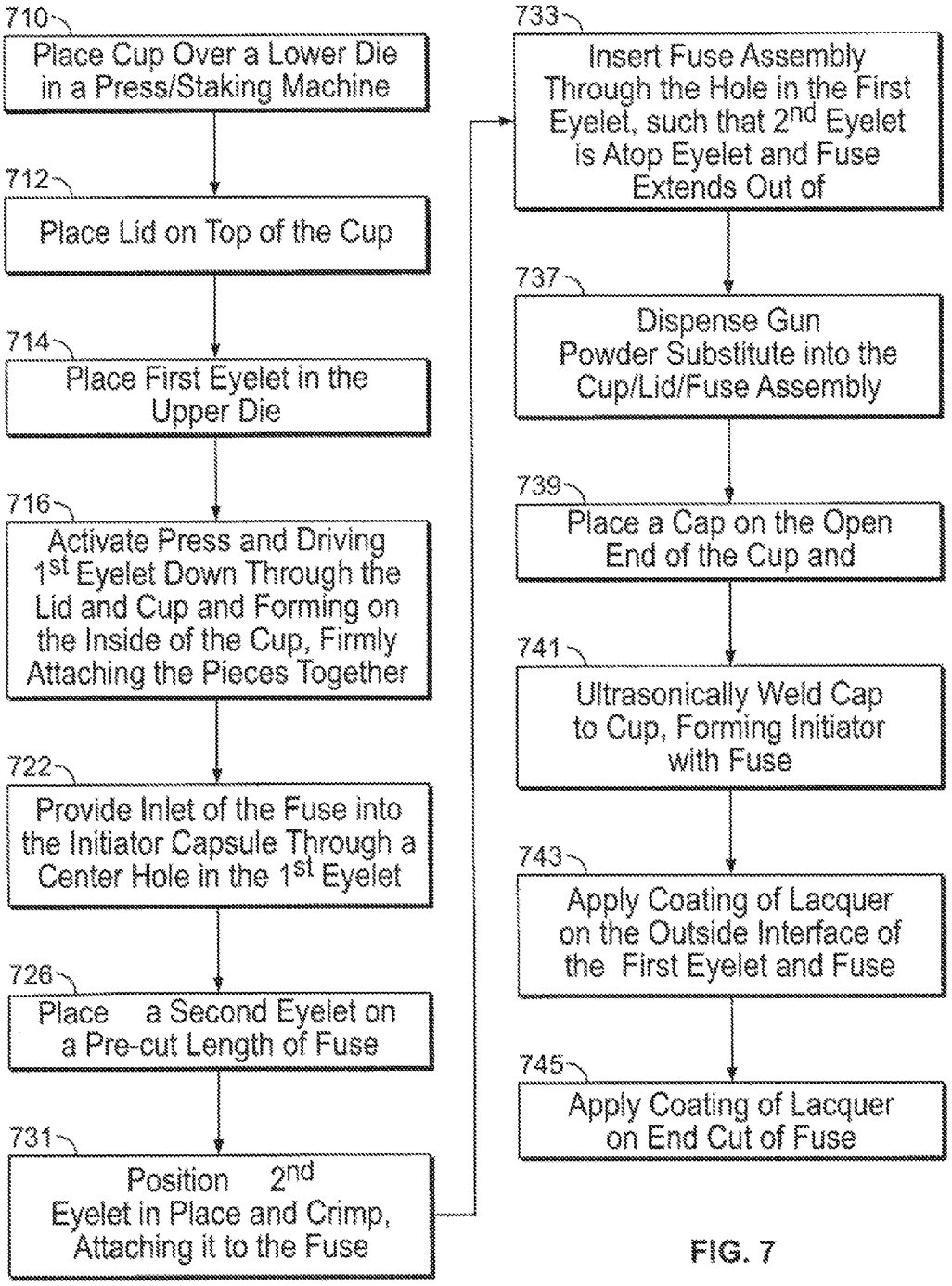
FIG. 7 shows an exemplary method of making an initiator with fuse for an automatic stovetop suppressor, in accordance with an exemplary embodiment of the present invention.

FIG. 7 shows an exemplary method of making an initiator with fuse for an automatic stovetop suppressor, in accordance with an exemplary embodiment of the present invention. A faster and more consistent flame activated initiator for an automatic stovetop fire suppressor is obtained in the absence of increased manufacturing time and costs.

Figure 8A:
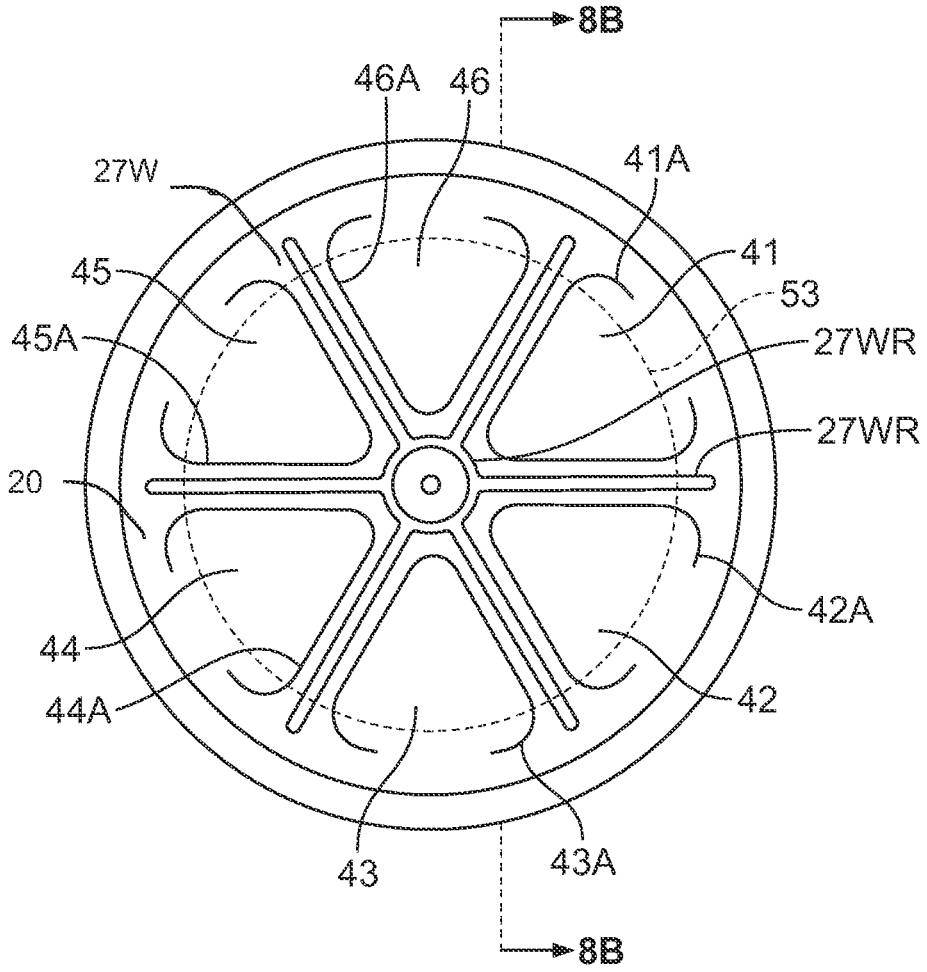
FIGS. 8A and 8B show a bottom view of an outside of a container lid and cross section of the lid as taken along line 8*ba*-8*b*, respectively, in accordance with an exemplary embodiment of the present invention.
Figure 8B:
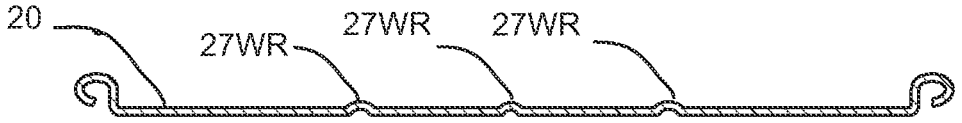

A coating of lacquer is then placed on the outside interface of the first eyelet and fuse. This seals the fuse to the eyelet to prevent the gun powder substitute from flowing out at that interface. A coating of lacquer is also placed on the end of the fuse to seal if from the environment 745. The lacquer to the end cut of the fuse may have already been applied during fuse formation and, in turn, this last coating of lacquer, 745, would not be needed, in accordance with an exemplary embodiment of the present invention. Referring to FIG. 7, place an initiator cup over a lower die in a press/staking machine 710, place a fire suppressor container lid on a top side of the cup 712, place a first eyelet in the upper die 714, and activate press, driving first eyelet down through the lid and cup and forming on the inside of the cup, firmly attaching the pieces together 716. Provide inlet of the fuse into the initiator capsule through a center hole in the first eyelet 722. Place a second eyelet on a pre-cut length of fuse 726. Crimp second eyelet, attaching it to the fuse 731; and insert fuse with the crimped second eyelet through an inside of the cup through the inlet and resting the second eyelet atop the first eyelet 733. At this point the angle cut end of the fuse extends below an outside of the suppressor container lid, as shown for example in FIG. 4. Referring again to FIG. 7, dispense gun powder substitute into the cup 737; place a cap on the top open end of the cup; and ultrasonically weld the cap to the cup 741. Apply a coating of lacquer to the outside interface of the first eyelet and the fuse 743, forming an initiator for an automatic stovetop fire suppressor with fuse. In accordance with an exemplary embodiment of the present invention, the lacquer is a nitro-cellulose lacquer. In accordance with another exemplary method embodiment of the present invention, a coating of nitrocellulose lacquer is applied to the angle end cut of the fuse 745, FIGS. 8A and 8B show view of an outside of a container lid 20 and cross section of the lid as taken along line 8B-8B, respectively, in accordance with an exemplary embodiment of the present invention. Once assembled, the fuse extends through the lid exposing its cut end past the outside side of the lid, not shown. Referring to FIG. 8A, the bottom lid 20 has grooves or scored lines 41A-46A selectively formed on the outside thereof to facilitate breaking or rupturing of the bottom end into separate tear-open segments 41-46 without fragmentation to form openings 41B-46B, openings not shown, only in the bottom end or bottom wall portion, lid 20, when the free ends of the segments are forced outward to allow the fire extinguishing powder 49, shown in FIG. 1, to fall or pass outward from the container onto the fire. Although the scoring is illustrated on the outside surface of the lid it can be on the inside surface thereof. The fuse 10-1, shown in FIG. 4, ignites when the temperature outside of the fire suppressor reaches a certain level to explode the charge 36, also shown in FIG. 4. When this occurs, the force of the explosion ruptures the scored or weakened lines and forces the tear open segments 41-46 outward to form the openings 41B-46B. The fire extinguishing powder then falls out of container 40, shown in FIG. 1, for example, to extinguish any fire below which may be in a frying pan, for example.

Still referring to FIGS. 8A and 8B, the non-erupting portions of the lid 20 is referred to as the web 27W of the lid 20. Embossed reinforcing ribs 27WR are formed in the lid 20 to make the web 27W stiffer and to assist in minimizing any problem of the segments 41-46 or vanes not opening outward.

The embossing forms a center circle with radially extending ribs between break open segments 41-46. The ribs 27WR may be formed by bending the web 27W outward after the score lines 41A are formed, which tends to pull metal away from the score lines 41A-46A and may facilitate opening of the segments 41-46.

The time between a fire starting on a stove and the fuse on a flame activated automatic stovetop fire extinguishing unit lighting, actuation time, is desired to be as small as possible. The present invention improves fire suppressor actuation time and repeatability of actuation time. Exemplary embodiments include an angle cut fuse end.

While specific alternatives to steps of the invention have been described herein, additional alternatives not specifically disclosed but known in the art are intended to fall within the scope of the invention. Thus, it is understood that other applications of the present invention will be apparent to those skilled in the art upon reading the described embodiments and after consideration of the appended drawings.

What is claimed is:

1. A method of making a fuse for an automatic stovetop fire suppressor, the method comprising:

acquiring a spool of fuse;

pulling the fuse off of the spool with rollers;

roller feed feeding the fuse along a cutting plane to a cutting blade;

positioning a cutting blade perpendicular to the cutting plane;

positioning the blade at a 45 degree angle from a fuse length axis; positioning the blade from the spool to obtain a desired fuse length; and cutting the fuse with the blade, the fuse being configured for an automatic stovetop fire suppressor.

2. The method according to claim 1, further comprising:

sharing the fuse of desired length from the spool of fuse with the blade at a 45 degree angle to the fuse length axis;

cutting the fuse with the blade perpendicular to cutting plane.

3. The method according to claim 2, wherein:

coating a first cut fuse end with a nitro-cellulose lacquer; and not-coating a second cut fuse end with nitro-cellulose lacquer.

4. The method according to claim 1, wherein:

the fuse is a visco fuse.

* * * * *